United States Patent [19]

Schneider et al.

[11] Patent Number: 4,516,447

[45] Date of Patent: May 14, 1985

[54] NUMERICALLY CONTROLLED GROOVE-STAMPING MACHINE

[75] Inventors: Franz Schneider, Göppingen; Rolf Ruhl, Rechberghausen, both of Fed. Rep. of Germany

[73] Assignee: L. Schuler GmbH, Fed. Rep. of Germany

[21] Appl. No.: 150,292

[22] Filed: May 16, 1980

[30] Foreign Application Priority Data

May 16, 1979 [DE] Fed. Rep. of Germany ..... 2919687

[51] Int. Cl.[3] ..... B21D 28/22

[52] U.S. Cl. ..... 83/71; 83/154; 83/281; 83/551; 414/744 A

[58] Field of Search ..... 414/222-226, 414/744 R-744 C; 29/563; 83/256, 71, 267, 410, 411 R, 412, 414, 552, 405, 404, 449-551, 563, 564, 154, 281

[56] References Cited

U.S. PATENT DOCUMENTS

| | | | |
|---|---|---|---|
| 3,283,918 | 11/1966 | De Vol | 414/744 R |
| 3,571,873 | 3/1971 | Muller | 83/405 X |
| 3,623,385 | 11/1971 | Schneider et al. | 83/405 X |
| 3,718,216 | 2/1973 | Wilson | 414/744 A |
| 4,052,780 | 10/1977 | Daniels | 414/744 A |
| 4,220,062 | 9/1980 | Blanz | 83/551 X |
| 4,232,575 | 11/1980 | Schneider et al. | 83/917 X |

*Primary Examiner*—James M. Meister

*Attorney, Agent, or Firm*—Craig & Burns

[57] ABSTRACT

A numerically controlled groove-stamping machine which includes an indexing unit rotatable stepwise by means of a positioning drive about a rotational axis as a function of a stroke of a punch of the groove-stamping machine. The indexing unit is adapted to be driven, in a stepwise fashion, in two intersecting directions running at right angles to the rotational axis. A numerically controlled automatic multiple tool set is provided with the set being equipped with, for example, a stator groove and cut-off tool, a rotor groove tool, and vent hole tools. The tools of the multiple tool set, in accordance with the work steps to be executed, are adapted to be brought into engagement in an individually controllable manner.

1 Claim, 4 Drawing Figures

102'
M
10
103'
M
104
M
11
21
106
20
16
12
13
14
15
21'
20'
19
22
17
103
22
M
18
23
101
M
24
26
28
25
27
102
M
CNC
105

M
102'
10
103'
M
11
104
M
16
12
13
14
15
21
21'
106
19
20
20'
23
17
103
M
22
18
101
M
24
22
26
28
25
27
M
102
105
CNC

NUMERICALLY CONTROLLED GROOVE-STAMPING MACHINE

The present invention relates to a punching or groove-stamping arrangement and, more particularly, to a pneumatically controlled automatic groove-stamping machine for stamping blanks utilized for rotor and/or stator laminations of electrical machines, with the arrangement including an indexing or divider unit rotatable in a stepwise manner, by means of a positioning drive, about a rotational axis as a function of a stroke of a punch, upon which traversable paths may be superimposed by means of additional positioning drives in a stepwise fashion in two intersecting directions which extend at right angles to the rotational axis.

A groove-stamping machine of the aforementioned type is proposed in, for example, German Patentschrift No. 1,627,227 published (Ausgabetag) Mar. 5, 1973 wherein a rotational axis of a blank support table is movable radially with respect to a center of rotation of such rotational axis in two directions at right angles to each other. It is proposed numerically controlled segment slotter is employed for grooving dynamo laminations which have a very large radius, which laminations are broken down into circular segments. This proposed groove-stamping machine is designed in such a fashion that each punch stroke produces a resultant movement of an indexing unit corresponding to a rotational movement about a center of a circle located far outside of the indexing unit.

In German Offenlegungsschrift No. 25 26 765 published (Offenlegungstag) Dec. 30, 1976, a stamping and notching machine is provided with numerically controlled tool-changing devices, wherein upper and lower tools to be brought into operational engagement are removed from a round magazine or turret.

German Patentschrift No. 2,108,231 published (Offenlegunstag) Sept. 7, 1972 also proposes a numerically controlled segment slotter; however, the axis of rotation of the blank support table is shifted away from the blank support table in a direction toward the slotting machine or, more exactly, shifted away into an area of a punch tool.

In German Offenlegungsschrift No. 24 11 439 published (Offenlegungstag) Sept. 25, 1975, a numerically controlled segment slotter is proposed in which the rotational axis of the blank support table is movable in one direction with the slotting machine itself being movable in another direction at right angles to the rotational axis of the blank support table.

In German Offenlegungsschrift No. 25 27 982 published (Offenlegungstag) Jan. 13, 1977, an automatic notching machine is proposed which includes a notching press and a five-armed feed and discharge device constructed as a turnstile or turntable having magnetic conveying rails which are switchable by way of a control means. An automatic notching press of this type is normally employed to produce, for example, notched stator laminations from unnotched blanks and unnotched rotor laminations separated from the stator laminations for electrical machines.

In German Offenlegungsschrift No. 22 22 582 published (Offenlegungstag) Nov. 22, 1973, an automatic notching press with a feed and discharge device is proposed with the feed and discharge device being arranged linearly and with elevating platforms which are, for example, combined with chain conveyors, being employed instead of turntables or rotating magazines so that, with similar action, a stack unloading and stacking stations are provided.

Additionally, in commonly assigned U.S. application Ser. No. 961,246, now U.S. Pat. No. 4,232,575, issued Nov. 11, 1980, an arrangement for notching circular blanks is proposed which arrangement includes at least one notching machine, a rotatably mounted table means for supporting the blanks at the notching machine, and an adjusting drive means for adjusting the notching machine in a first direction of movement radially with respect to a spacially fixed axis of rotation of the supporting table means. An additional adjusting means is provided for selectively driving the supporting table means, with means being provided for enabling a relative movement between the supporting table means and the at least one notching machine in a second direction of movement at a right angle to the first direction of movement. By virtue of this construction, an automatic arrangement for punching out or slotting circular blanks so as to form stator and/or rotor laminations by way of a conventional slotting machine is achieved whereby stacks of laminations are produced which may have spiral or oblique slots.

In commonly assigned U.S. patent application Ser. No. 013,062, now U.S. Pat. No. 4,331,049 issues a numerically controlled automatic notching arrangement for notching blanks is provided which arrangement comprises at least one notching machine having a numerically controlled tool changing means and a multi-armed feeding and removing means including an indexable turntable adapted to convey blanks between at least one stack unloading station, an aligning station, a processing station, a first stacking station and a second stacking station. A conveyor means is provided for linking the stack unloading station with the second stacking station, which conveyor means is driven independently of the indexable turntable whereby the blanks may be selectively conveyed from the second stacking station to the stack unloading station.

In commonly assigned U.S. patent application Ser. No. 075,485, now abandoned, an automatically numerically controlled slotting machine apparatus is provided which includes a tool changing device having a plurality of respective upper and lower tool dyes mounted in a tool holder. Means are provided for selectively moving nonoperative ones of the lower tool dyes to positions below a plane of conveyance of the workpieces being processed by the slotting machine and a tool holder guide means is provided for movably guiding the tool holder along a straight guide path and a plane at a tangent to the workpieces to be machined whereby tool changes may be effected by moving the tool holder against the straight guide path.

The contents of the above-noted U.S. patent applications are incorporated herein by reference and, additional reference is also made to brochures published by the assignee of this application titled "Programmable CNC-Controlled Segment Notching Press" and "Manually Loaded an Automatic Notching Machines", for further background information.

The aim underlying the present invention essentially resides in constructing a numerically controlled groove-stamping machine starting from the premise of the above-noted state of the art, which machine serves as a basis for a manufacturing system which may be used to produce finished stacks of laminations for rotors and/or stators of electrical machines automatically and without manual intervention.

In accordance with advantageous features of the present invention, a numerically controlled automatic multiple tool set is provided which set is equipped with, for example, a stator groove/cut-off tool, rotor groove tool, and vent hole tools. The tools of the multiple tool set being adapted to be brought into engagement in accordance with the work step to be executed in an individually controllable manner.

In accordance with further advantageous features of the present invention, the multiple tool set is incorporatable into a tool incorporation area of the groove stamping machine with the groove stamping machine including an indexable and/or controllable punch, corresponding to the number of tools of the multiple tool set.

Advantageously, the multiple tool set is constructed as a conventional tool changing device and the tools of the tool changing device are displaceable into the tool incorporation area and are adapted to be brought into operation along a curved track.

It is also possible in accordance with the present invention for the tools of the tool changing device to be displaceable into the tool incorporation area and be brought into operation along a straight track.

Advantageously, in accordance with further features of the present invention, the tools of the tool changing device are displaceable on tracks for predetermined equal distances with the tools then being lockable in a tool incorporation area to a punch and on a turret block.

To selectively position the tools of the tool-changing device, in accordance with the present invention, a numerically controlled positioning drive is provided for displacing the tools for positioning on the tracks.

In accordance with yet a further feature of the present invention, a tool which is brought into working engagement is rotatable about an axis located in a direction of the stroke of the tool.

Advantageously, a numerically controlled groove-stamping machine according to the present invention is provided with an automatic dispensing, loading, unloading, and stacking device which may, for example, be composed of numerically controlled automatic handling machinery.

By virtue of constructing a numerically controlled groove-stamping machine in accordance with the present invention, it is possible to realize an automated manufacture of grooved laminations for electrical machines of nearly all known types such as, for example, machines with lamination stacks provided with diagonal grooves, machines with conical lamination stacks, etc.

Accordingly, it is an object of the present invention to provide a numerically controlled groove-stamping machine which avoids, by simple means, shortcomings and disadvantages encountered in the prior art.

Another object of the present invention resides in providing a numerically controlled groove-stamping machine which enables a production with finished stacks of laminations for rotors and stators of electrical machines automatically and without manual intervention.

Another object of the present invention resides in providing a numerically controlled groove-stamping machine which functions reliably under all operating conditions.

These and other objects, features, and advantages of the present invention will become more apparent from the following description when taken in connection with the accompanying drawings which show, for the purpose of illustration only, several embodiments in accordance with the present invention, and wherein.

Figure 1:
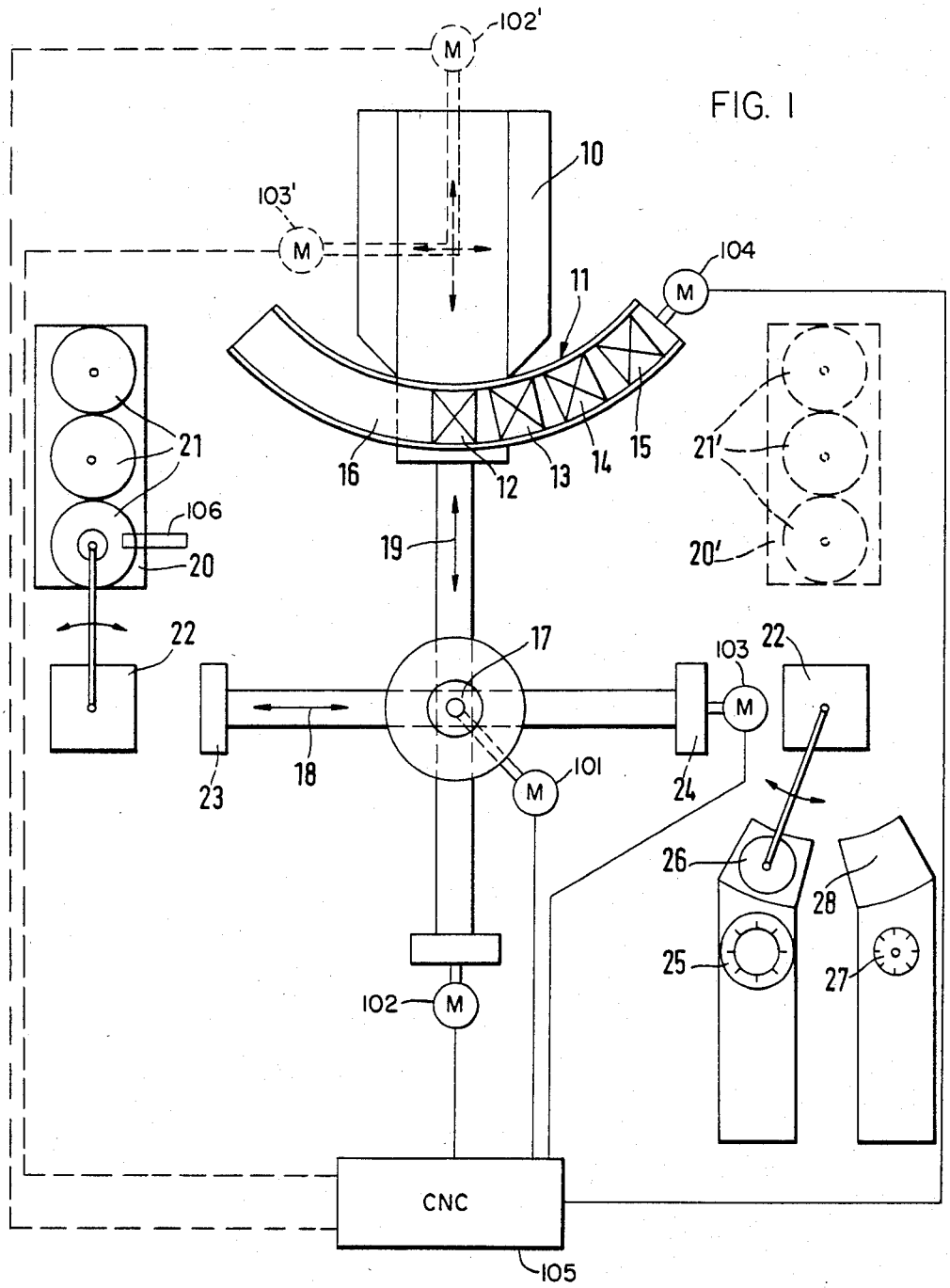
FIG. 1 is a schematic plan view of a numerically controlled groove-stamping machine in accordance with the present invention provided with a multiple tool set displaceable along a curved track.

Before describing, in detail, the particular improved numerically controlled groove-stamping machine in accordance with the present invention, it should be observed that the present invention resides primarily in a novel structural combination of conventional components and not in the particular detailed constructions thereof. Accordingly, the structure, control, and arrangement of these conventional components have, for the most part, been illustrated in the drawings by readily understandable block representations and schematic diagrams, which show only those specific details which are pertinent to the present invention, in order not to obscure the disclosure with structural details which will be readily apparent to those skilled in the art having the benefit of the description herein.

Referring now to the drawings wherein like reference numerals are used throughout the various views to designate like part and, more particularly, to FIG. 1, according to this figure, a numerically controlled groove-stamping machine 10 is equipped with a multiple tool set generally designated by the reference numeral 11, which tool set may, for example, consist of a vent hole tool 12, for stamping stator vent holes, a stator groove and cut-off tool 13, an additional vent hole tool 14 for, for example, stamping rotor vent holes, and a rotor groove tool 15. The tools 12–15 of the multiple tool set 11 are displaceably mounted for movement along a curved track 16 in a conventional manner and, once the respective tools have been brought to a working position, they are lockable to a table and/or punch by suitable conventional means.

The numerically controlled groove-stamping machine is also provided with an indexing unit 17 which is rotatable in a stepwise fashion by a conventional positioning drive 101. The indexing unit 17 is displaceable horizontally along a first track 18 in a direction nearly parallel to an end of the numerically controlled groove-stamping machine 10. The indexing unit 17 is further displaceable horizontally along a second track 19 which is at or nearly at a right angle to the first track 18.

A dispensing or loading station 20 is provided for accommodating ungrooved blanks 21 to be processed. The ungrooved blanks 21 are removed from the loading station 20 by a numerically controlled automatic handling device 22 which also transports the ungrooved blanks 21, after they have been oriented and/or rotated by a conventional double-blank monitoring device 106 to a loading position 23 of the indexing unit 17.

Another automatic handling device 22 is associated with an unloading position 24 of the indexing unit 17. The automatic handling device 22 is adapted to dispense the finished stator laminations 25 to a stator stacking station 26 and finished rotor laminations 27 to a rotor stacking station 28 with the grooves in the respective laminations being in alignment. Alternatively, in lieu of the dispensing station 20, a dispensing station 20' may be provided whereby the indexing unit 17 may be loaded and unloaded by using only one automatic handling device 22. It is also possible in accordance with the present invention, in special cases, to mount the numerically controlled groove-stamping machine 10 so as to be displaceable along tracks 18 and 19 while the indexing unit 17 is mounted in a fixed position. Control of drive motors 101, 102, 103 and 104 is provided by CNC unit 105.

Figure 2:
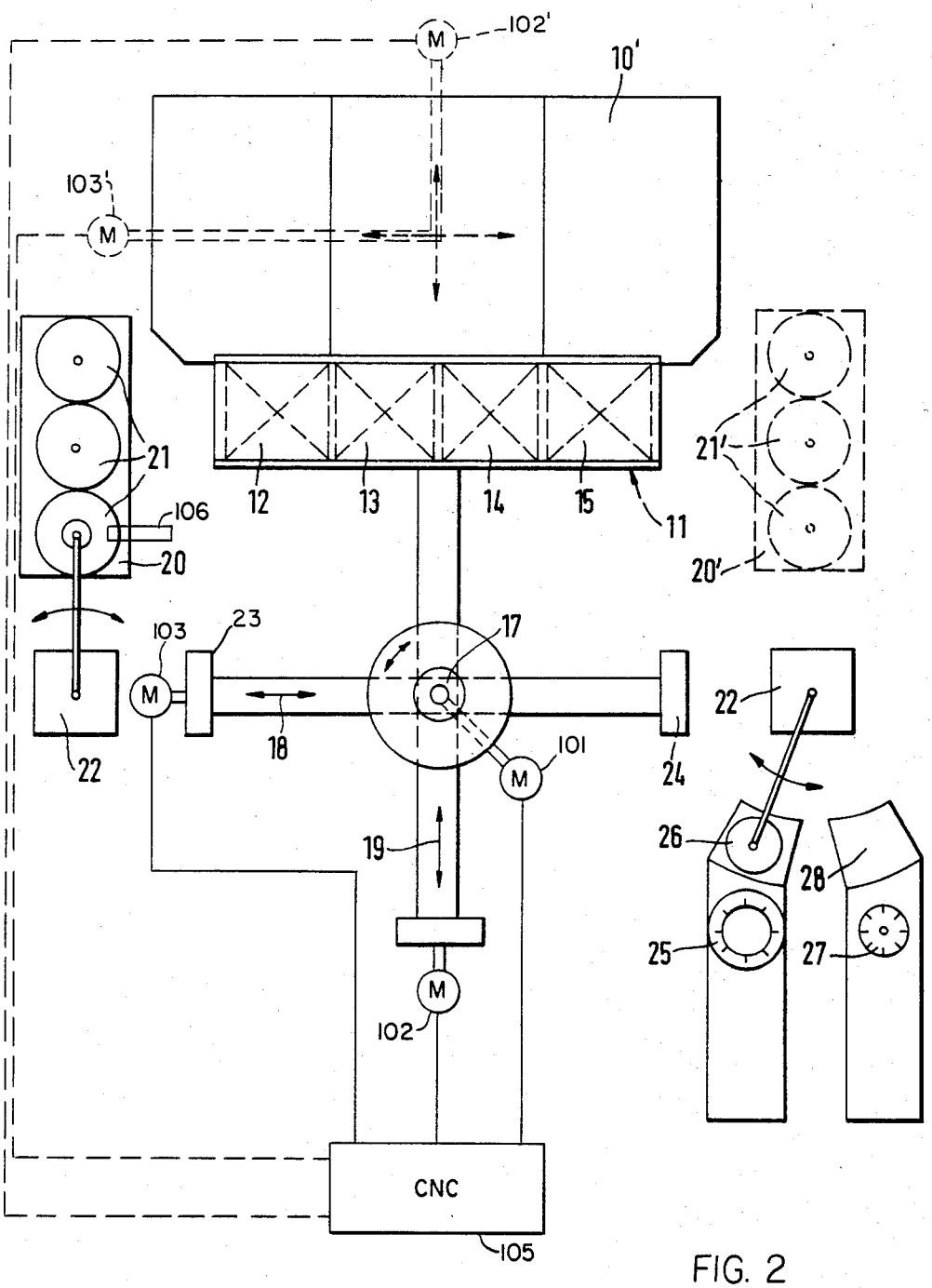
FIG. 2 is a schematic plan view of another embodiment of a numerically controlled groove-stamping machine in accordance with the present invention provided with a multiple tool set mounted in a fixed position.

As shown in FIG. 2, a numerically controlled groove-stamping machine 10 is provided having a housing which, in contrast to the groove-stamping machine 10 of FIG. 1, is constructed so as to project further outwardly since the multiple tool set 11, in the construction of FIG. 2, is mounted in a fixed position between the table and a punch of the groove-stamping machine 10'. As with the construction of FIG. 1, the multiple tool set 11 includes vent hole tools 12, 14, a stator groove and cut-off tool 13, and a rotor groove 15. The indexing unit 17 is displaceable along tracks 18, 19 while the dispensing station 20, automatic handling devices 22, stacking stations 26 and 28, as well as the alternative shown in FIG. 1, are provided in the same manner in the construction of FIG. 2.

Figure 3:
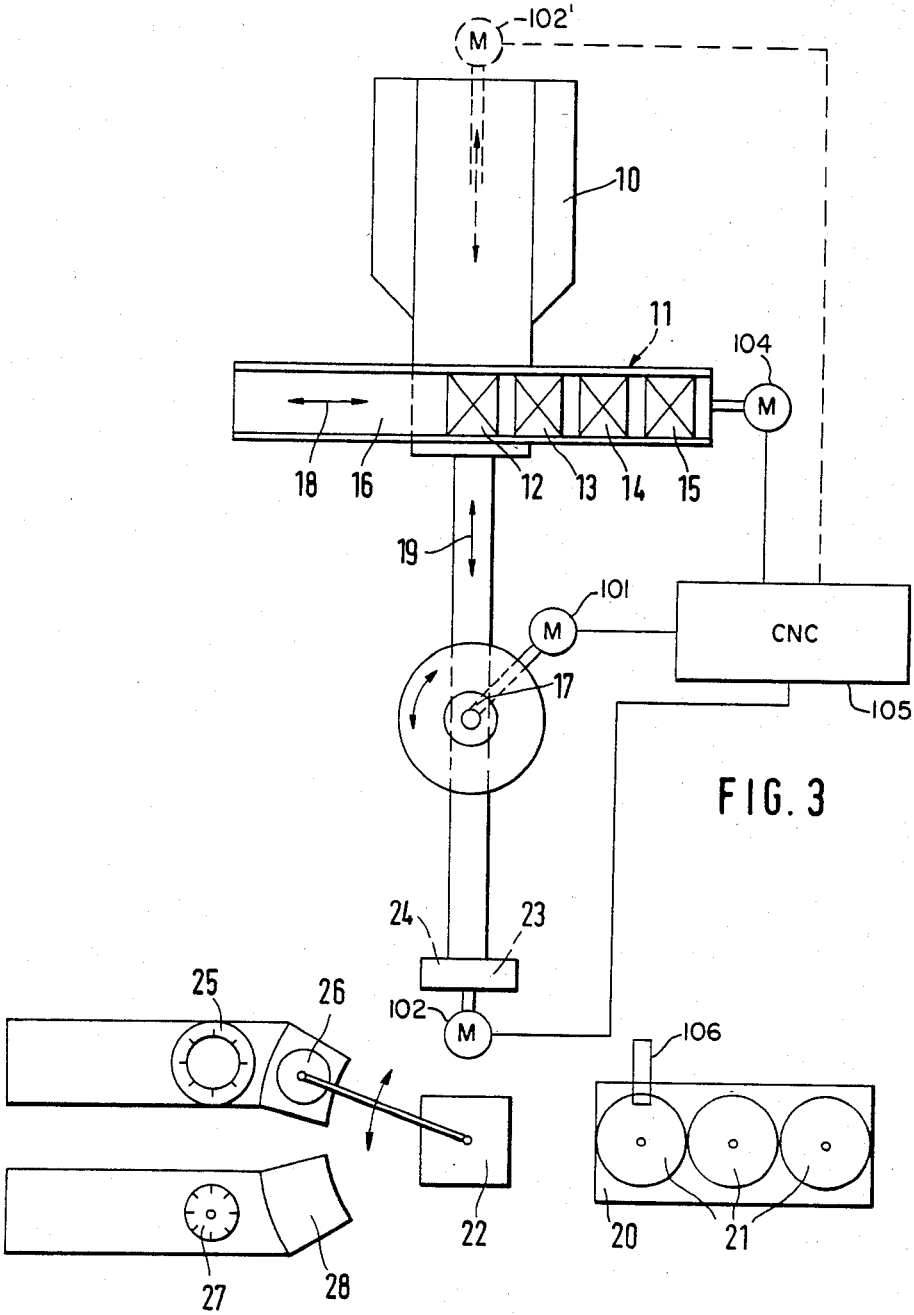
FIG. 3 is a schematic plan view of a further embodiment of a numerically controlled groove-stamping machine in accordance with the present invention provided with a multiple tool set mounted displaceably on a straight track.

In the construction of FIG. 3, a multiple tool set 11 is constructed in a manner equivalent to that of FIG. 1; however, a straight track 16 is provided for the tools 12–15, which track runs at a tangent to the indexing unit 17. The track 16 and tools 12–15 of the multiple tool set 11 are constructed as a conventional tool-changing device. In contradistinction to the construction of FIG. 1, in FIG. 3, the tools 12–15 operate in one position so that the first track 18 is identical to the track 16 of the multiple tool set 11. In this arrangement, the loading position 23 and unloading position 24 are at the same location and only a single automatic handling device 22 is necessary. The dispensing station 20, stator stacking station 26 and rotor stacking station 28 of the construction of FIG. 3 correspond to the example described hereinabove in connection with FIGS. 1 and 2.

Figure 4:
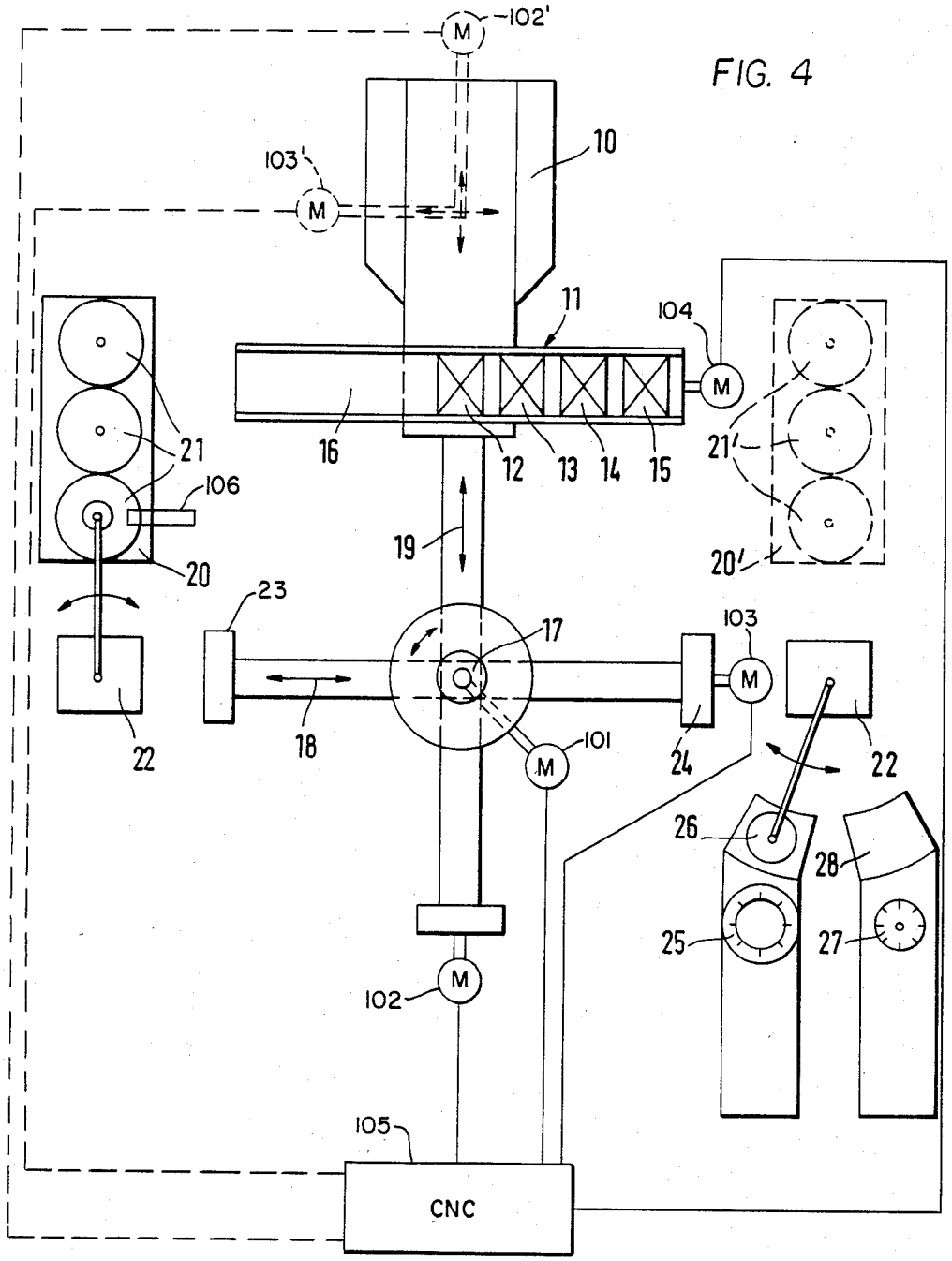
FIG. 4 is a schematic plan view of the numerically controlled groove-stamping machine of FIG. 1 provided with a straight track.

The embodiment of FIG. 4 corresponds in its construction to that of FIG. 1; however, in the FIG. 4 construction, the track 16 extends along a straight line. As to the rest of the constructional features of FIG. 4, such features are identical to that shown in FIG. 1.

The exemplary embodiments shown in FIGS. 1, 2 and 4 may also be arranged so as to provide for combining of the loading position 23 and unloading position 24 functionally so that one automatic handling device 22 would suffice under certain conditions.

The numerically controlled groove-stamping machine 10 or 10' in accordance with the present invention operates in the following manner:

Ungrooved blanks 21 are located in the dispensing station 20 so as to be ready to be dispensed. By means of the associated automatic handling device 22, for example, an ungrooved blank 21 is dispensed and, possibly, oriented by conventional means and turned through a predetermined angle. At the loading position 23, the blank 21 is fed to the indexing unit 17. The indexing unit 17 is moved to a working position together with the blank 21 on tracks 18 and 19 by a positioning drive 103 and 102.

For a first processing pass, the vent hole tool 12 for the stator is engaged and cuts vent holes for the stator in the ungrooved blank 21 after the indexing unit 17 has been rotated stepwise in accordance with a programmed hole pattern.

When the above processing step is complete, the stator groove and cut-off tool 13 replaces the vent hole tool 12 whereupon an electric drive (not shown) brings the stator groove and cut-off tool 13 into engagement by, for example, locking means. In contradistinction of FIG. 3, a motor, driven to specific positions, is not required. During the second processing pass, the stator grooves are again cut in accordance with a programmed stator groove pattern. At the same time, the stator 25 is cut off from the rotor blank 27 which has yet to be processed. After this processing pass is complete, the tool is once again changed and the vent hole tool 14 for the rotor 27 is engaged.

In the meantime, the indexing unit 17 has been run at high speed to the unloading position 24 and the stator lamination has been removed by the automatic handling device 22 and stacked on the stator stacking station 26. The indexing unit 17 is then rapidly returned to the working position together with the unprocessed rotor blank and the vent holes are then cut in the rotor blank 27 by the vent hole tool 14. Subsequently, following a further tool change wherein the rotor groove tool 15 is engaged, the last processing pass takes place wherein the rotor grooves are cut in the rotor blank 27 in accordance with a rotor groove program. During the time that the finished rotor lamination 27 is being removed by the automatic handling device 22 at the unloading position 24 and stacked on the rotor stacking station 28, the multiple tool set 11 is returned to its original position while the indexing unit 17 is loaded at the loading position with a new ungrooved blank 21 and the above-described process is then repeated.

A significant advantage of the groove-stamping machine 10 in accordance with the present invention resides in the fact that the ungrooved blanks 21 are ready to be processed when they are loaded on the indexing unit 17 thus permitting lamination stacks composed of stator laminations 25 and rotor laminations 27 to be produced which are aligned exactly without additional selection criteria and/or finishing work being required.

Lamination stacks for special motor with, for example, diagonal grooves, may be produced in a simple fashion, with the embodiments illustrated in FIGS. 1, 2 and 4, by, for example, moving the indexing unit 17 a short distance along the first track 18 while, with the embodiment of FIG. 3, the tool itself can travel to different positions.

In special applications, it may be advantageous within the scope of the present invention to execute the movements on the first track 18 and/or second track 19 using the housing of the numerically controlled groove-stamping machine itself as indicated by the dashed arrows in the drawings.

By appropriately constructing the groove-stamping machine 10 and its control, lamination segments similar to those which constitute the conventional segments may be readily produced.

While we have shown and described several embodiments in accordance with the present invention, it is understood that the same is not limited thereto but is susceptible of numerous changes and modifications as known to those skilled in the art and we, therefore, do not wish to be limited to the details shown and described herein but intend to cover all such changes and modifications as are encompassed by the scope of the appended claims.

We claim:

1. A numerically controlled groove-stamping machine for processing workpieces including a numerically controlled automatic multiple tool set comprising a plurality of individual tools, an indexing unit means for presenting workpieces for engagement by at least one of said individual tools, positioning drive means for rotating the indexing unit about a rotational axis in a stepwise fashion, means for displacing the indexing unit along a first path, and means for displacing the indexing unit along a second path which extends substantially at a right angle to the first path and to the rotational axis, and in that means are provided for bringing the respective tools of the tool set into engagement in an individually controllable manner in accordance with work steps to be executed by the groove-stamping machine.

* * * * *